US010544699B2

(12) United States Patent
Clayton

(10) Patent No.: US 10,544,699 B2
(45) Date of Patent: Jan. 28, 2020

(54) SYSTEM AND METHOD FOR MINIMIZING THE TURBINE BLADE TO VANE PLATFORM OVERLAP GAP

(71) Applicant: Rolls-Royce Corporation, Indianapolis, IN (US)

(72) Inventor: Neil Anthony Clayton, Plainfield, IN (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 104 days.

(21) Appl. No.: 15/847,465

(22) Filed: Dec. 19, 2017

(65) Prior Publication Data

US 2019/0186280 A1 Jun. 20, 2019

(51) Int. Cl.

| | |
|---|---|
| ***F01D 11/12*** | (2006.01) |
| ***F01D 11/00*** | (2006.01) |
| ***F01D 5/08*** | (2006.01) |

(52) U.S. Cl.

CPC ..... *F01D 11/122* (2013.01); *F01D 5/082* (2013.01); *F01D 11/003* (2013.01); *F05D 2220/32* (2013.01); *F05D 2230/90* (2013.01); *F05D 2240/55* (2013.01); *F05D 2240/81* (2013.01); *F05D 2300/134* (2013.01); *F05D 2300/17* (2013.01); *F05D 2300/2112* (2013.01); *F05D 2300/611* (2013.01)

(58) Field of Classification Search

None

See application file for complete search history.

(56) References Cited

U.S. PATENT DOCUMENTS

| | | | | |
|---|---|---|---|---|
| 3,367,628 A * | 2/1968 | Fitton | F01D 11/005 415/110 |
| 4,522,559 A * | 6/1985 | Burge | F01D 25/26 415/138 |
| 5,735,671 A * | 4/1998 | Brauer | F01D 5/081 416/95 |
| 5,935,407 A | 8/1999 | Nenov et al. | |
| 6,190,124 B1 | 2/2001 | Freling et al. | |
| 6,194,086 B1 | 2/2001 | Nenov et al. | |
| 7,500,824 B2 * | 3/2009 | Cheng | F01D 11/001 415/173.4 |

(Continued)

FOREIGN PATENT DOCUMENTS

| | | |
|---|---|---|
| EP | 0919699 | 7/2011 |
| WO | WO2014/074370 | 5/2014 |

*Primary Examiner* — Michael Lebentritt

(74) *Attorney, Agent, or Firm* — McCracken & Gillen LLC

(57) ABSTRACT

A component and method for minimizing a gap between a blade platform ledge and a vane platform ledge in a turbine engine. The blade platform supports turbine blades attached to a shaft. The movable blade platform is positioned adjacent to a stationary vane platform having vanes mounted on an outer surface. The blade and vane platforms are separated by the gap between the platform ledges. During manufacture, an abrasive coating is applied to the surface of the blade platform ledges so that the coating contacts the vane platform ledge when the engine is started. The abrasive coating on the turbine blade platform cuts the surface of the vane platform ledge to form a gap sufficient to permit unobstructed motion of the blade platform, yet of minimal size to limit the flow of gas between the space within and the space outside the platforms.

20 Claims, 4 Drawing Sheets

(56) References Cited

U.S. PATENT DOCUMENTS 8,616,847 B2 12/2013 Allen
9,561,986 B2 * 2/2017 Lipkin ..... C04B 41/52
2002/0170176 A1 * 11/2002 Rigney ..... C23C 4/00 29/889.1
2005/0111963 A1 * 5/2005 Tiemann ..... B22C 9/22 415/115
2005/0111966 A1 * 5/2005 Metheny ..... F01D 5/183 415/116
2007/0184298 A1 * 8/2007 Ochiai ..... C23C 26/00 428/689
2008/0096045 A1 * 4/2008 Fairbourn ..... C23C 18/04 428/641
2009/0311552 A1 * 12/2009 Manier ..... C23C 4/18 428/614
2011/0044798 A1 * 2/2011 Digard Brou De Cuissart ..... F01D 9/041 415/115
2011/0182721 A1 * 7/2011 Saunders ..... C01B 21/0682 415/173.7
2011/0200752 A1 * 8/2011 Dorn ..... B05B 12/20 427/282
2013/0011265 A1 * 1/2013 Miller ..... F01D 11/008 416/191
2013/0209217 A1 * 8/2013 Butler ..... F01D 9/041 415/1
2015/0322804 A1 * 11/2015 Butler ..... C23C 28/3455 416/241 B
2016/0010488 A1 * 1/2016 Albers ..... F04D 29/563 415/148
2016/0146031 A1 * 5/2016 Ahmad ..... F01D 11/005 415/208.1
2016/0319684 A1 * 11/2016 Scholtes ..... F01D 11/001
2016/0341051 A1 11/2016 Hewitt et al.
2017/0152753 A1 * 6/2017 Serra ..... C23C 4/134
2018/0045072 A1 * 2/2018 Hannam ..... F01D 5/14
2018/0355742 A1 * 12/2018 Telman ..... F01D 5/187
2019/0003321 A1 * 1/2019 Van Sluytman ..... C23C 28/042

* cited by examiner

SYSTEM AND METHOD FOR MINIMIZING THE TURBINE BLADE TO VANE PLATFORM OVERLAP GAP

FIELD OF DISCLOSURE

The present invention relates to methods and systems for controlling gas flow in turbine engines, and more particularly, for minimizing the overlap gap between blade and vane platforms in turbine engines.

BACKGROUND

Jet engines operate by forcing a fluid, such as a gas, through the engine to propel the structure attached to the engine through the fluid. The process of forcing the fluid through the engine typically involves the use of fans, compressors, and turbines rotating on a shaft that extends axially through the engine. In each stage of the engine, various flow paths of gas are formed to provide either power or cooling as needed.

The turbine stages of the engine include substantially cylindrical turbine disks having a substantially cylindrical blade platform supporting the turbine blades rotating about the shaft. The rotation of the blades is at least partially caused by compressed hot gas flowing through the blades. The blades may be configured by shape or orientation to more efficiently move about the shaft in response to the flow of hot gas.

The blade disks may be positioned on opposite sides of stationary vane disks having a substantially cylindrical vane platform, which supports vanes extending radially from the vane platform. The vane platform and the blade platform each have ledges that extend axially toward each other and overlap axially to form a radial gap. The vane platforms and the blade platforms are arranged axially through the turbine portion of the engine. The vane and blade platforms together form a substantially cylindrical case allowing for a gas flow path to form on an outside surface of the vane and blade platform case and another gas flow path to form inside the vane and blade platform case.

The gas flow paths formed inside and outside the vane and blade platform case typically have a different function. In one example, the gas flow path through the vanes and blades outside of the vane and blade platform may be a hot gas flow that drives the turbine blades, while the gas flow path through the inside of the vane and blade platform case may be a cooler gas flow used to cool the disk rim areas at the gap between the vane and blade platforms. The hot gas flow temperatures typically exceed the capability of the components in the disk rim areas of the rotating disks. The cool gas flow is used to cool the disk rim areas.

The cool gas flow is a secondary flow cooling air taken after it has passed through the compressor of the engine. Higher pressure air is typically needed to purge the many cavities located around the turbine disk rims under the vane platforms. Sufficient pressure is needed so that the secondary flow air flows through the disk rim cavities and into the turbine flow path and actively purge the disk rim cavities. The active purge flow prevents the hot gas flow from entering the disk rim cavities and heating up the turbine disks and spacers beyond their allowable material-based temperature limits.

The gaps that exist between the turbine blade and vane overlaps need to be sized to avoid a rub with today's typical turbine engine configurations. A significant rub at these locations can be damaging to the turbine blade platforms and can potentially lead to platform overhang creep and/or cracking and the leading or trailing edge of the platform can actually be liberated in extreme cases. To minimize the potential for a turbine blade and vane to rub at the platform overlaps, the nominal gap needs to be sized larger than otherwise necessary due to the dimensional tolerance stack-up in the components. This larger than required gap leads to the need for additional secondary flow air to be used to positively purge the disk rim cavities and prevent flow path ingress. This additional secondary flow air is basically an efficiency reduction for the turbine and results in higher secondary flow cooling for the engine at a given operating power. If this platform overlap gap can be minimized to remove the effects of tolerances on the components the secondary flow cooling air can thus be minimized with associated benefits to engine performance.

SUMMARY

In view of the above, devices, systems and methods are provided to minimize the gap between the overlap of blade and vane platforms in turbine engines. In one aspect of the invention, a gas turbine engine component is provided. An example component includes a rigid, substantially cylindrical platform configured to surround a shaft extending axially through the cylindrical platform. The platform supports a plurality of blades extending from the shaft and the blades rotate during operation of the turbine engine. Each blade extends to an outer blade portion extending radially from an outer surface of the platform. A platform ledge is formed on the cylindrical platform. The platform ledge has a ledge surface with an abrasive coating at least partially covering the ledge surface. The abrasive coating contacts an overlapping vane platform ledge surface on a vane platform ledge on a stationary platform supporting a plurality of vanes. During engine break-in the abrasive coating cuts the vane platform ledge surface creating a gap with a minimized platform clearance when the platform ledge moves against the vane platform ledge.

In another aspect, a turbine engine is provided. An example turbine engine comprises a plurality of turbine blades extending from a turbine shaft. A substantially cylindrical, rigid blade platform supports the plurality of blades and rotates with a rotation of the blades during operation of the turbine engine. Each blade includes an outer blade portion extending radially from an outer surface of the blade platform. A blade platform ledge is formed on the blade platform. The blade platform ledge has a blade platform ledge surface. A plurality of stationary vanes extend from a substantially cylindrical, rigid, stationary vane platform positioned adjacent the blade platform in an axial direction. An abrasive coating at least partially covers the blade platform ledge surface and is formed to contact an overlapping vane platform ledge surface on a vane platform ledge on the stationary vane platform supporting the plurality of vanes. The abrasive coating cuts the vane platform ledge surface creating a gap with a minimized platform clearance when the platform ledge moves against the vane platform ledge.

In another aspect, a method is provided for minimizing gas flow between a hot gas flow path and a cooling gas flow path in a turbine engine.

According to an example method, an abrasive coating at least partially covering a blade platform ledge surface is formed on a blade platform ledge extending from a substantially cylindrical, rigid blade platform configured to support a plurality of blades extending from a shaft. Each blade has an outer blade portion extending radially from an outer surface of the blade platform. The blade platform and the plurality of blades are positioned adjacent, in an axial direction, to a plurality of stationary vanes extending from a substantially cylindrical, rigid, stationary vane platform. The blade platform and vane platform are closely positioned such that the blade platform ledge overlaps a vane platform ledge and the abrasive coating on the blade platform ledge is in contact with the vane platform ledge. A gap is created with a minimized platform clearance between the blade platform ledge and the vane platform ledge by rotating the blade platform and plurality of blades. The abrasive coating cuts the vane platform ledge surface when the blade platform ledge moves while in contact with the vane platform ledge. The minimized platform clearance minimizes gas flow between the first gas flow path and the second gas flow path.

Some examples of devices, systems, and methods for minimizing the turbine blade to vane gap between blade and vane platform overlaps are outlined above rather broadly in order that the detailed description thereof may be better understood, and in order that the present contribution to the art may be better appreciated. Additional example implementations of the devices, systems, and methods are described below and will form the subject matter of the claims appended hereto. In this respect, before explaining at least one example of the devices, systems, and methods in detail, it is to be understood that the devices, systems, and methods are not limited in their application to the details of construction or to the arrangements of the components set forth in the following description or illustrated in the drawings. Other example implementations of the devices, systems, and methods may be developed, practiced and carried out in various ways. Also, it is to be understood that the phraseology and terminology employed herein are for the purpose of the description and should not be regarded as limiting.

BRIEF DESCRIPTION OF THE DRAWINGS

Example embodiments can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Disclosed herein are systems and methods for minimizing a gap between a blade platform ledge and a vane platform ledge in a turbine engine where the blade and vane platform ledges overlap. An abrasive coating is applied to the blade platform ledge during the manufacture of the engine. The coating is applied in an amount sufficient to contact the vane platform ledge when the engine is operated, but a clearance will be present at assembly. When the engine is started, the rotation of the blades and blade platforms causes the blade platform radius to increase until the abrasive coating cuts into the vane platform ledge surface. As the engine stabilizes, the blade platform growth relative to the vane reduces until the vane platform ledge surface no longer contacts the blade platform ledge surface. The remaining gap between the overhang of the blade platform ledge and the overhang of the vane platform ledge is minimized to the smallest possible gap removing the dimensional tolerance variations on the parts in the possible stack-up while allowing the blade platform to rotate without contacting the vane platform. The blade platform cuts its' own clearance relative to the vane and this is the minimum possible that could be achieved at this location.

Example implementations find advantageous use in the turbine section of turbine jet engines. The abrasive coating may also be applied to blade platforms adjacent to stationary vane platforms in other rotating machinery where a minimum gap between the edges of the blade and vane platforms is desired. While the description below focuses on the turbine section of a turbine jet engine, example implementations may find advantageous use in compressor sections or other sections that may involve a similar structure and similar advantages are desired.

Figure 1:
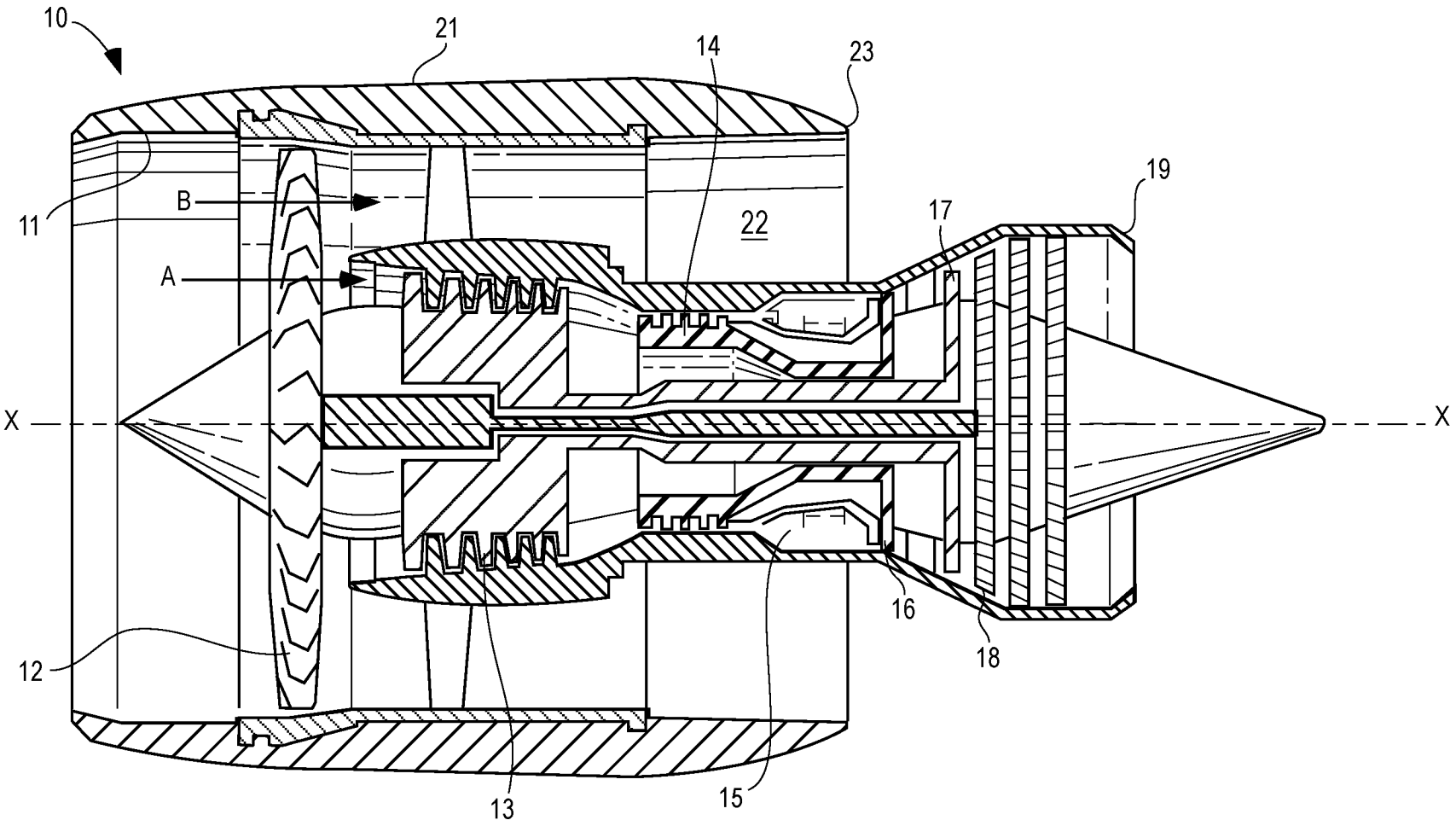
FIG. 1 is a side cross-sectional view through a ducted fan gas turbine engine.

With reference to FIG. 1, a fan gas turbine engine of a type in which examples of the invention may find advantageous use is generally indicated at 10 and has a principal and rotational axis X-X. The engine 10 comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and a core engine exhaust nozzle 19.

A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high pressure compressor 14 is directed into the combustion equip-ment 15 where it is mixed with fuel and the mixture combusted. The resultant hot combustion products then expand through, and thereby drive the high, intermediate and low pressure turbines 16, 17, 18 before being exhausted through the nozzle 19 to provide additional propulsive thrust. The high, intermediate and low pressure turbines respectively drive the high and intermediate pressure compressors 14, 13 and the fan 12 by suitable interconnecting shafts.

The engine 10 in FIG. 1 is one example of the type of engines in which example implementations of a component or method for minimizing the overlap gap between blade and vane platforms in turbine engines may find advantageous use. It is noted, for example, that the engine 10 described with reference to FIG. 1 is a three-shaft engine. Examples of components and methods for minimizing the overlap gap between blade and vane platforms in turbine engines described herein may also be implemented in two-shaft or single shaft engines.

Figure 2:
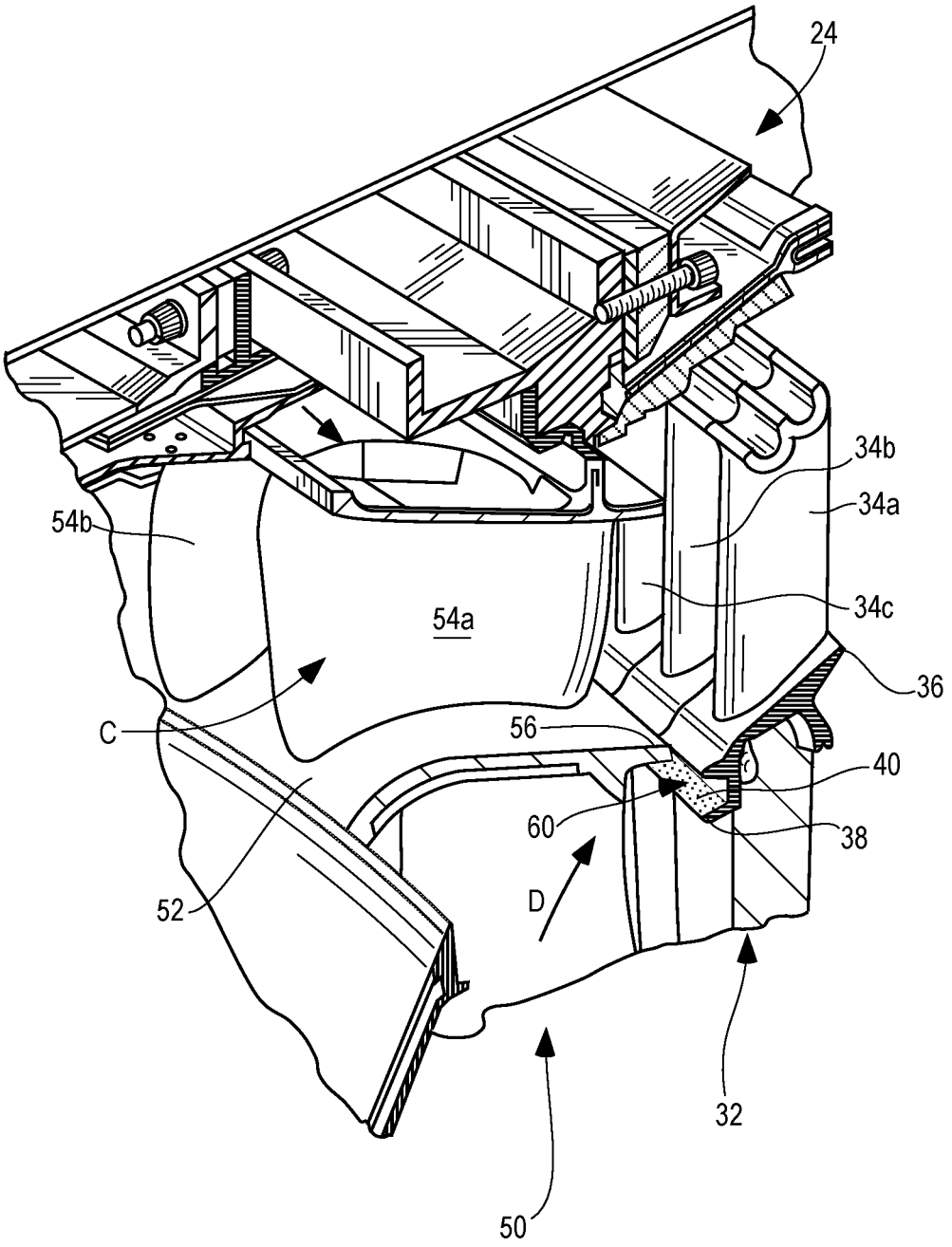
FIG. 2 is an isometric, view with portions broken away of a high pressure turbine section of the gas turbine engine of FIG. 1.
Figure 3:
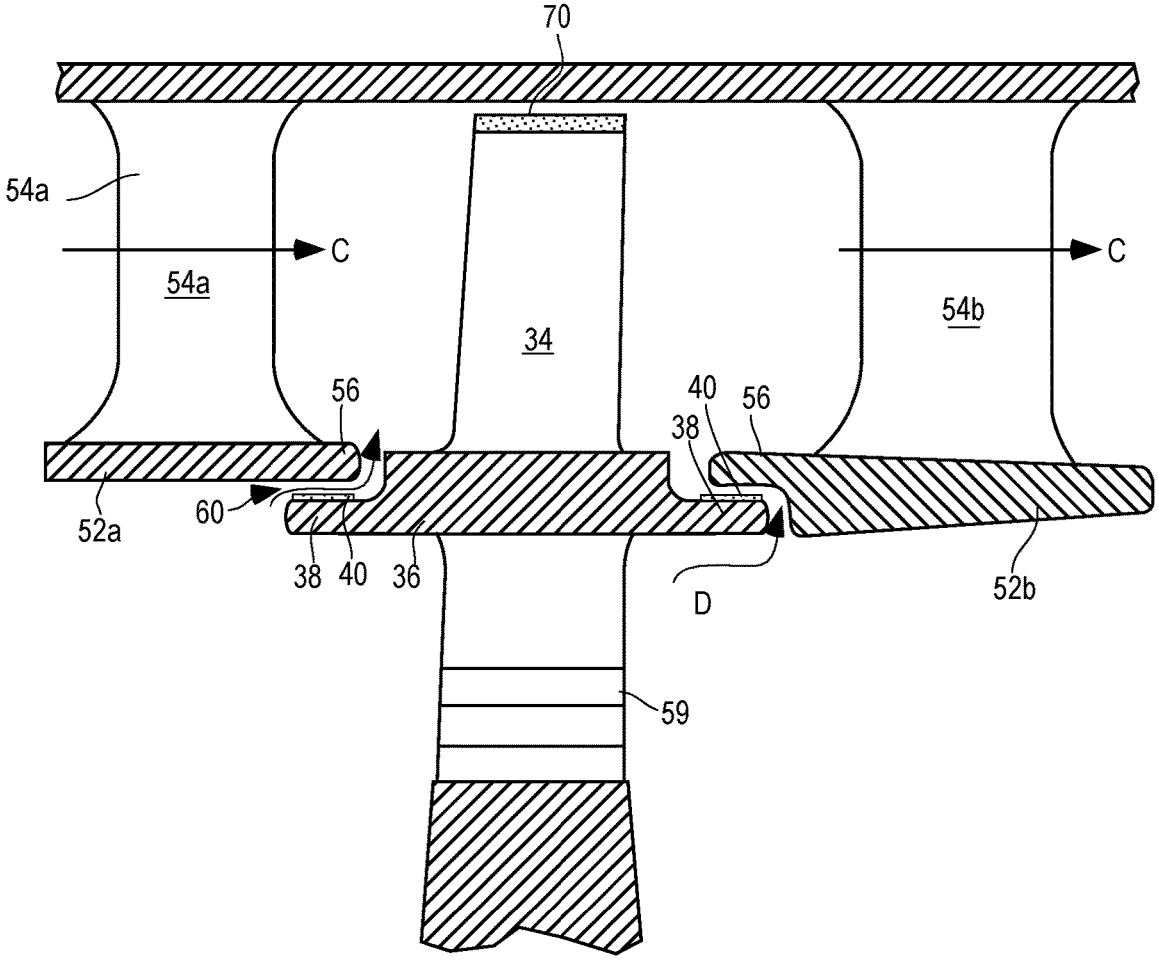
FIG. 3 is a side cross-sectional view of the high pressure turbine section of the gas turbine engine of FIG. 1.
Figure 4:
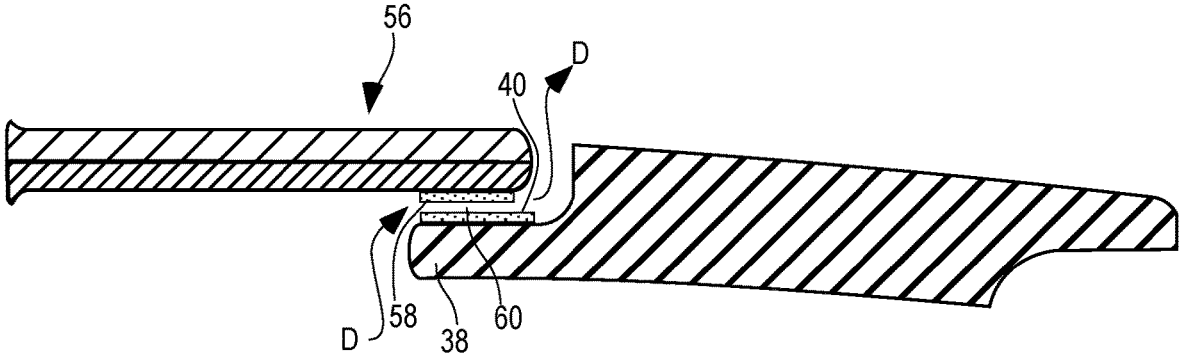
FIG. 4 is an enlarged, fragmentary, side cross-sectional view of the gap between the vane platform and the blade platform of the gas turbine engine of FIG. 1.

FIG. 2 is a perspective, sectional cut-out view of a high pressure turbine section 24 of a turbine jet engine. FIG. 2 shows a sectioned view of a movable blade disk 32 and a stationary vane disk 50. FIG. 3 is a side cross-sectional view of the high pressure turbine section 24 of the turbine jet engine. FIG. 4 is a side cross-sectional view of the gap between the vane platform and the blade platform.

Referring to FIGS. 2-4, the blade disk 32 includes a plurality of blades extending from a turbine shaft (not shown) with corresponding blade portions 34*a*, 34*b*, 34*c* extending from an outer surface of a blade platform 36. The blade platform 36 has a substantially cylindrical form extending along a circle to surround the turbine shaft with the turbine blades distributed uniformly around the shaft. In an example implementation, the blade platform 36 may be an assembly of blade platform members, each configured to connect serially with a plurality of blade platform members 35 along a circle to form the blade platform 36. FIG. 2 illustrates such an assembly of blade platform members 35 separated by a member gap 37. Each blade platform member 35 has a blade opening to permit one of the plurality of blades to extend there through.

The stationary vane disk 50 includes a plurality of vanes 54*a*, 54*b*, 54*c* mounted on a vane platform 52 that also has a substantially cylindrical form extending along a circle to surround the shaft. The vane platform 52 may be an assembly of arcuate sections with one or more vanes 54 mounted on each section. The vanes 54*a*, 54*b*, 54*c* may be uniformly distributed on an outer surface of the vane platform 52. The vanes 54 may be configured to guide a hot gas flow along a hot gas flow path C directing the hot gas towards the blades 34. The blades 34 may be configured to move to rotate the shaft as the hot gas flows against the blades 34.

The blade platform 36 extends axially to edges on either side of the blades 34. A ledge 38 is formed on the edges of the blade platform 36 to overlap a vane platform ledge 56 on the vane platform 52. A gap 60 is formed between the blade platform ledge 38 and the vane platform ledge 56. The gap 60 is necessary to allow the blades 34 to move while the vanes 54 remain stationary. The gap 60 also functions to permit a cooling air to flow in a cooling air flow path D to cool areas of the blade platform 36 and the vane platform 52 within cavities formed in the blade platform 36 and vane platform 52 structures. However, if the gap 60 is too large, more air flows in the gap 60 than necessary to cool reducing the efficiency of the engine. In an example implementation, an abrasive coating 40 is formed on the blade platform ledge surface during manufacture of the engine. The abrasive coating 40 is applied in a sufficient amount to make contact with the surface of the vane platform ledge 56 opposite the gap 60. When the engine is started for the first time, the abrasive coating 40 cuts the surface of the vane platform ledge until the gap 60 is formed. The gap 60 that remains during operation minimized, yet sufficient to permit the blade platform 36 to move relative to the stationary vane platform 52.

It is noted that blades are typically provided with a tip abrasive coating 70 at their axially distal tips. The tip abrasive coating 70 cuts into an abradable blade track to minimize gas flow between the blade tip and the inner surface of the engine case. The abrasive coating 40 that may be applied to the blade platform ledge may be of the same material used for the tip abrasive coating 70. In addition, efficiencies in production may be achieved by applying the abrasive coating to the tips and the platform ledges in the same step. The abrasive coating 40 may be applied by any suitable method, such as, for example without limitation, laminating, plating, spraying, painting, brazing, welding, or depositing the coating on the blade platform ledge. The method of applying the abrasive coating 40 may depend on the material used for the coating or other factors.

In example implementations, the abrasive coating may be made of any suitable material capable of cutting the material selected for manufacture of the vane platform. Examples of materials that may be used for abrasive coatings in example implementations include:

1. TBT-429™,
2. LC017™,
3. a cobalt/chromium/aluminum/yttrium (CoCrAlY) alloy,
4. a nickel/chromium/aluminum/yttrium (NiCrAlY) alloy,
5. a cobalt/nickel/chromium/aluminum/yttrium (CoNiCrAlY) alloy,
6. a cobalt/nickel/yttrium/chromium (CoNiYCr) alloy,
7. aluminum oxide,
8. zirconium,
9. hard particles embedded in a retaining matrix,
10. hard particles of cubic boron nitride embedded in a retaining matrix, or
11. hard particles embedded in a retaining matrix of nickel, cobalt, iron, or an alloy of any one or more thereof.

The abrasive coating 40 may be applied on the turbine blade platform ledges 38 to cut the bare material on the vane platform ledge 56. In other implementations, a relatively soft and easy to cut abradable coating 58 (see FIG. 4) may be applied to the surface of the vane platform ledge 56. Examples of abradable coatings that may be applied to the vane platform ledge 56 include a CoNiCrAlY alloy, a ceramic-based system, or any suitable relatively soft coating that may be cut by the abrasive coating 40 on the blade platform ledge 38. The application of the abrasive coating 40 on turbine blade platforms may be used on both High Pressure (HP) Turbines and on Low Pressure (LP) Turbines.

Figure 5:
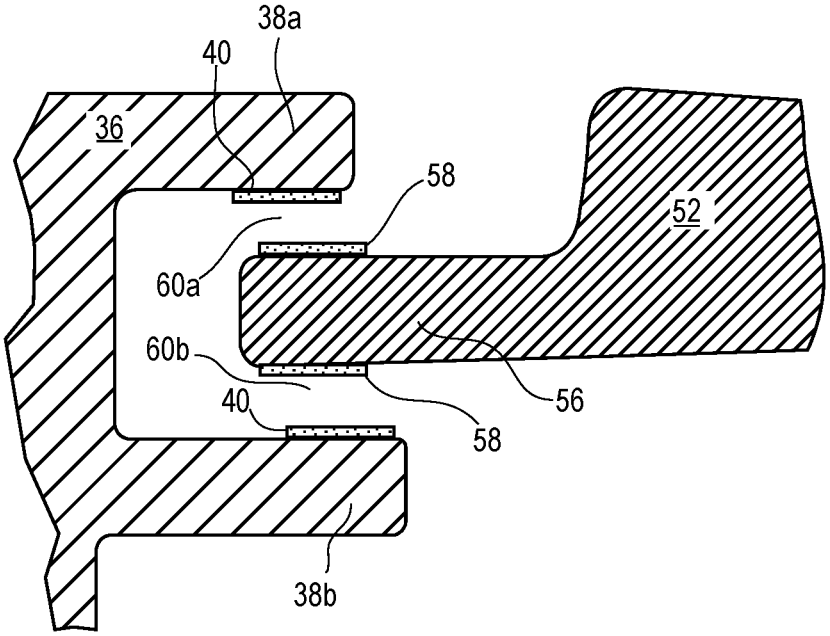
FIG. 5 is an enlarged, fragmentary, side cross-section view of the gap between the vane platform and the blade platform where the vane platform ledge overlaps two ledges of the blade platform.

In some implementations, the blade platform 36 may extend axially to multiple blade platform ledges, which may overlap one or more vane platform ledges. FIG. 5 is an enlarged, fragmentary, side cross-section view of multiple gaps 60*a* and 60*b* formed between two blade platform ledges 38*a* and 38*b* and a single vane platform ledge 56. The abrasive coating 40 is applied to the blade platform ledge surface on the upper ledge 38*a* and on the lower ledge 38*b* where the ledges overlap the vane platform ledge 56. The example illustrated in FIG. 5 shows an abradable coating 58 on both surfaces of the vane platform ledge 56 facing blade platform ledges 38*a* and 38*b*.

Figure 6:
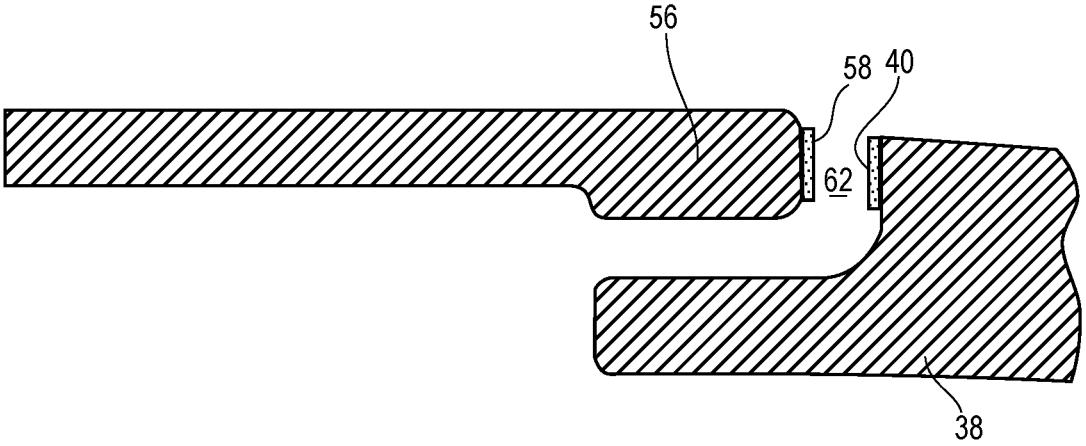
FIG. 6 is an enlarged, fragmentary, side cross-section view of the gap extending axially from the vane platform ledge to the blade platform ledge.

In some implementations, the blade platform 36 may extend axially to form an axial gap with the vane platform ledge 52. FIG. 6 is an enlarged, fragmentary, side cross-section view of an axial gap 62 extending axially from the vane platform ledge 56 to the blade platform ledge 38. The abradable coating 58 is formed on the surface of the vane platform ledge 56 facing the axial gap 62 and the abrasive coating 40 is formed on the surface of the blade platform ledge 38 facing the axial gap 62. In other implementations, the abrasive coating 40 may be formed to create an axial gap 62 and a radial gap 60.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure. Numerous modifications to the present disclosure will be apparent to those skilled in the art in view of the foregoing description. It should be understood that the illustrated embodiments are exemplary only, and should not be taken as limiting the scope of the disclosure.

What is claimed is:

1. A gas turbine engine component comprising:

a rigid, substantially cylindrical blade platform configured to surround a shaft extending axially through the cylindrical blade platform, to support a plurality of blades extending from the shaft, and to rotate with a rotation of the blades during operation of the turbine engine, each blade having an outer blade portion extending radially from an outer surface of the platform;

a platform ledge formed on the cylindrical platform, the platform ledge having a substantially continuously planar ledge surface; and an abrasive coating at least partially covering the substantially continuously planar ledge surface and formed to contact an overlapping substantially continuously planar vane platform ledge surface on a vane platform ledge on a stationary platform supporting a plurality of vanes during operation of the gas turbine engine, wherein the abrasive coating at least partially covering the planar ledge surface cuts the overlapping planar vane platform ledge surface during operation of the gas turbine engine creating a gap with a minimized platform clearance when the platform ledge moves against the overlapping planar vane platform ledge.

2. The gas turbine engine component of claim 1, wherein the cylindrical blade platform is an assembly of individual blade platform members configured to connect serially with a plurality of blade platform members along a circle to form the cylindrical blade platform, the blade platform member having a blade opening to permit one of the plurality of blades to extend there through.

3. The turbine engine component of claim 1, wherein the plurality of blades are compressor blades.

4. The turbine engine component of claim 1, wherein the outer blade portion of each blade extends to a blade tip comprising a tip abrasive coating configured to cut into an abradable blade track.

5. The turbine engine component of claim 1, wherein the abrasive coating is made of any of TBT-429™, LC017™, a cobalt/chromium/aluminum/yttrium (CoCrAlY) alloy, a nickel/chromium/aluminum/yttrium (NiCrAlY) alloy, a cobalt/nickel/chromium/aluminum/yttrium (CoNiCrAlY) alloy, a cobalt/nickel/yttrium/chromium (CoNiYCr) alloy, aluminum oxide, zirconium, hard particles embedded in a retaining matrix, hard particles of cubic boron nitride embedded in a retaining matrix, or hard particles embedded in a retaining matrix of nickel, cobalt, iron, or an alloy of any one or more thereof.

6. A turbine engine comprising:

a plurality of turbine blades extending from a turbine shaft;

a substantially cylindrical, rigid blade platform configured to support the plurality of blades, and to rotate with a rotation of the blades during operation of the turbine engine, each blade having an outer blade portion extending radially from an outer surface of the blade platform;

a blade platform ledge formed on the blade platform, the blade platform ledge having a substantially continuously planar blade platform ledge surface;

a plurality of stationary vanes extending from a substantially cylindrical, rigid, stationary vane platform positioned adjacent the blade platform in an axial direction; and an abrasive coating at least partially covering the substantially continuously planar blade platform ledge surface and formed to contact an overlapping substantially continuously planar vane platform ledge surface on a vane platform ledge on the stationary vane platform supporting the plurality of vanes, wherein the abrasive coating at least partially covering the planar blade platform ledge surface cuts the overlapping planar vane platform ledge surface during operation of the gas turbine engine creating a gap with a minimized platform clearance when the platform ledge moves against the overlapping planar vane platform ledge.

7. The turbine engine of claim 6, wherein the blade platform includes a plurality of blade openings and the plurality of blades extend axially from the shaft through the blade openings.

8. The turbine engine of claim 6, wherein the plurality of blades are turbine blades.

9. The turbine engine of claim 6, wherein the plurality of blades are compressor blades.

10. The turbine engine of claim 6, wherein the outer blade portion of each blade extends to a blade tip comprising a tip abrasive coating configured to cut into an abradable blade track.

11. The turbine engine of claim 6, wherein the abrasive coating is made of any of TBT-429™, LC017™, a cobalt/chromium/aluminum/yttrium (CoCrAlY) alloy, a nickel/chromium/aluminum/yttrium (NiCrAlY) alloy, a cobalt/nickel/chromium/aluminum/yttrium (CoNiCrAlY) alloy, a cobalt/nickel/yttrium/chromium (CoNiYCr) alloy, aluminum oxide, zirconium, hard particles embedded in a retaining matrix, hard particles of cubic boron nitride embedded in a retaining matrix, or hard particles embedded in a retaining matrix of nickel, cobalt, iron, or an alloy of any one or more thereof.

12. A method for minimizing gas flow between a hot gas flow path and a cooling gas flow path in a turbine engine comprising:

forming an abrasive coating at least partially covering a substantially continuously planar blade platform ledge surface on a blade platform ledge extending from a substantially cylindrical, rigid blade platform configured to support a plurality of blades extending from a shaft, each blade having an outer blade portion extending radially from an outer surface of the blade platform;

positioning the blade platform and the plurality of blades adjacent in an axial direction to a plurality of stationary vanes extending from a substantially cylindrical, rigid, stationary vane platform, wherein the blade platform and vane platform are closely positioned such that the substantially continuously planar blade platform ledge surface overlaps a substantially continuously planar vane platform ledge surface and the abrasive coating on the planar blade platform ledge surface is in contact with the planar vane platform ledge surface when the turbine gas engine is in operation; and creating a gap with a minimized platform clearance between the blade platform ledge and the vane platform ledge by rotating the blade platform and plurality of blades, wherein the abrasive coating cuts the planar vane platform ledge surface when the blade platform ledge surface moves while in contact with the vane platform ledge surface, wherein the minimized platform clearance minimizes gas flow between the first gas flow path and the second gas flow path.

13. The method of claim 12 wherein the abrasive coating is a platform abrasive coating, the method further comprising:

forming a tip abrasive coating on a tip of each blade, the tip abrasive coating configured to cut into an abradable blade track, wherein the step of forming the tip abrasive coating is performed substantially contemporaneously with the step of forming the platform abrasive coating.

14. The method of claim 13 wherein the gap is a platform gap, the method further comprising:

creating a tip gap with a minimized tip clearance between the blade tip and the abradable blade track by rotating the blade platform and the plurality of blades.

15. The method of claim 12 wherein the step of forming the abrasive coating comprises:

laminating, plating, spraying, painting, brazing, welding, or otherwise depositing the abrasive coating on the blade platform ledge surface.

16. The method of claim 12 wherein the step of forming the abrasive coating comprises using one of a cobalt/chromium/aluminum/yttrium (CoCrAlY) alloy, a nickel/chromium/aluminum/yttrium (NiCrAlY) alloy, a cobalt/nickel/chromium/aluminum/yttrium (CoNiCrAlY) alloy, or a cobalt/nickel/yttrium/chromium (CoNiYCr) alloy.

17. The method of claim 16 wherein the alloy operates as a retaining matrix, the method further comprising:

embedding hard particles into the alloy retaining matrix.

18. The method of claim 16 wherein the alloy operates as a retaining matrix, the method further comprising:

embedding hard particles of cubic boron nitride into the alloy retaining matrix.

19. The method of claim 12 wherein the step of forming the abrasive coating comprises:

attaching a layer of aluminum oxide or zirconium on the blade platform ledge surface.

20. The method of claim 12 further comprising the step of:

forming an abradable coating on at least part of a surface of the vane platform ledge overlapping the blade platform ledge.

* * * * *